US005736972A

United States Patent [19]

Kitagishi et al.

[11] Patent Number: 5,736,972

[45] Date of Patent: Apr. 7, 1998

[54] LIQUID CRYSTAL DISPLAY APPARATUS CAPABLE OF DISPLAYING A COMPLETE PICTURE IN RESPONSE TO AN INSUFFICIENT VIDEO SIGNAL

[75] Inventors: Hirohisa Kitagishi; Kazunori Kodama, both of Osaka, Japan

[73] Assignee: Sanyo Electric Co., Ltd., Moriguchi, Japan

[21] Appl. No.: 500,755

[22] Filed: Jul. 11, 1995

[30] Foreign Application Priority Data

Jul. 15, 1994 [JP] Japan ..... 6-163827
Jul. 15, 1994 [JP] Japan ..... 6-163828

[51] Int. Cl.[6] ..... G09G 3/36

[52] U.S. Cl. ..... 345/99; 345/93

[58] Field of Search ..... 345/99, 55, 84, 345/87, 90, 93, 94, 95, 97, 98, 100, 204, 208, 185, 200, 213

[56] References Cited

U.S. PATENT DOCUMENTS 5,119,083 6/1992 Fujisawa et al. ..... 345/200
5,136,282 8/1992 Inaba et al. ..... 345/97
5,598,178 1/1997 Kawamori ..... 345/93

*Primary Examiner*—Regina Liang
*Attorney, Agent, or Firm*—Armstrong, Westerman, Hattori, McLeland & Naughton

[57] ABSTRACT

A liquid crystal display apparatus includes first and second PLL circuits, a memory, and a liquid crystal panel. Dot data or line data of a video signal is written into the memory in response to a write clock signal from the first PLL circuit. Data are read from the memory in response to a read clock signal from the second PLL circuit. A read reset signal for reading dummy data is also supplied from the second PLL circuit to the memory. If the number of dot data the video signal has in one horizontal period is smaller than the number of horizontally arranged pixels of the liquid crystal panel, dummy data is read in response to the read reset signal after all the dot data in that one horizontal period have been read. On the other hand, if the number of line data in one vertical period is smaller than the number of vertically arranged pixels of the liquid crystal panel, dummy data is read in response to the read reset signal after all the line data in that one vertical period have been read. As a result, an optimal picture can be displayed on the liquid crystal panel.

5 Claims, 10 Drawing Sheets

LIQUID CRYSTAL DISPLAY APPARATUS CAPABLE OF DISPLAYING A COMPLETE PICTURE IN RESPONSE TO AN INSUFFICIENT VIDEO SIGNAL

BACKGROUND OF THE INVENTION

1. Field of the Invention

The present invention relates to a liquid crystal display apparatus for displaying a picture, and more particularly, to a liquid crystal display apparatus for appropriately displaying a picture regardless of the number of dot data or line data of an input video signal.

2. Description of the Background Art

A liquid crystal display apparatus displays a picture by synchronizing one dot of dot data in a video signal with one pixel of a display panel in one horizontal period. Furthermore, line data of one line (one scanning line) out of prescribed number of line data (data of a scanning line) a video signal has in one horizontal period is displayed corresponding to one vertical line in the display panel. This line data is a collection of dot data.

Such a liquid crystal display apparatus displays a picture in response to a video signal output from a computer. However, a video signal output from a computer forms a picture on a pixel-by-pixel basis and there is no correlation between pixels.

Accordingly, in order to display a picture in an optimal condition according to a video signal of a VGA (Video Graphics Array) having a horizontal data portion (dot data in one horizontal period) of 640 dots or the like on a liquid crystal panel having pixels of 640×480 (the number of pixels in a horizontal direction×the number of pixels in a vertical direction), dot data of the video signal and a sampling clock must be synchronized with each other in one to one correspondence. Such a synchronization method is referred to as pixel synchronization.

In such a liquid display apparatus as described above, if pixel synchronization is impossible due to characteristics of frequencies of a signal processing system, phase of a sampling clock must be adjusted to make pixel synchronization possible.

In recent years, computers of various specifications have been manufactured. In most cases, computers of different types output video signals having different characteristics. Therefore, a liquid crystal display apparatus connected to a computer for displaying a picture must adapt to computers of different types, that is, must have general-purpose properties.

FIG. 5 is a block diagram showing an arrangement of a main portion of a conventional liquid crystal display apparatus. Referring to FIG. 5, this liquid crystal display apparatus includes a polarity inversion circuit 70, a liquid crystal panel 80, a PLL circuit 20, and a microcomputer 30.

This liquid crystal display apparatus is connected to a computer (not shown). A video signal PS input from the computer has its polarity inverted by polarity inversion circuit 70 and is supplied to liquid crystal panel 80. Liquid crystal panel 80 includes a plurality of liquid crystal cells arranged in a matrix form, and two shift registers for respectively driving those liquid crystal cells in horizontal and vertical directions.

PLL circuit 20 includes a frequency divider (not shown) in a phase locked loop, and is constituted so that a frequency of an oscillating sampling clock signal SC can be varied by changing frequency division ratio of the frequency divider.

PLL circuit 20 receives a horizontal synchronizing signal HSS as a reference signal for phase synchronization, and receives data of frequency division ratio from microcomputer 3. The data of frequency division ratio supplied from microcomputer 3 is set to such a value that a sampling clock signal SC output from PLL circuit 20 and dot data of a video signal PS are synchronized with each other in one to one correspondence.

Such a method of synchronizing dot data and a sampling pulse signal with each other is referred to as pixel synchronization. Frequency division ratio of the frequency divider is set based on such data of frequency division ratio. Thus, PLL circuit 20 outputs a sampling clock signal SC for pixel synchronization of liquid crystal panel 80.

In this PLL circuit 20, an output signal of the frequency divider is a signal compared to a reference signal (this compared signal is hereinafter referred to as a comparison signal). Accordingly, this comparison signal is compared to a horizontal synchronizing signal HSS and is phase-synchronized with the horizontal synchronizing signal HSS.

As described above, data of frequency division ratio for carrying out pixel synchronization according to a connected computer is supplied from microcomputer 30 to PLL circuit 20. Furthermore, in PLL circuit 20, frequency division ratio of the frequency divider is set based on the data of frequency division ratio supplied from microcomputer 30. Thus, PLL circuit 20 outputs a sampling clock signal SC for pixel synchronization.

Liquid crystal panel 80 includes a driver, and receives a reset pulse signal RP in addition to a video signal and a sampling clock signal SC. This reset pulse signal RP is a signal for determining, out of line data of the video signal, line data with which display is initiated.

This reset pulse signal RP is a signal generated based on a vertical synchronizing signal which is supplied from a computer, having the same period as that of the vertical synchronizing signal, and having a phase different from that of the vertical synchronizing signal.

Upon display, line data with which display on a screen is started is determined in liquid crystal panel 80 based on the reset pulse signal RP. In other words, line data with which display is started is determined in response to generation of one pulse of the reset pulse signal RP.

The sampling clock signal SC is supplied to liquid crystal panel 80. Liquid crystal panel 80 includes a driver circuit (not shown) and displays a picture based on supplied video signal PS and sampling clock signal SC.

In order to display an optimal picture according to various computers which output video signals PS having characteristics different from each other in a conventional liquid crystal display apparatus having such an arrangement as described above, pixel synchronization must be carried out as shown in FIG. 6.

FIG. 6 is a timing chart showing conditions of signals which are pixel-synchronized with each other. A horizontal synchronizing signal HSS, a video signal PS, and a sampling clock signal SC are shown in FIG. 6. FIG. 6 shows an example in which liquid crystal panel 80 has 640 pixels in a horizontal direction. In FIG. 6, each pulse of sampling clock signal SC is shown by an upward arrow, and the number of each pulse is shown above the arrow.

In the case of liquid crystal panel 80 having 640 pixels in a horizontal direction, if the sampling clock signal SC of 640 dots and dot data of the video signal PS are pixel-synchronized with each other as shown in FIG. 6, a picture can be displayed in an optimal condition.

However, the number of dot data of a video signal PS in one horizontal period might be smaller than that of the horizontally arranged pixels in liquid crystal panel 80, depending on a type of a computer. In such a case, the following problems will occur. Those problems will now be described specifically.

FIG. 7 is a timing chart showing condition of signals obtained when the number of dot data of a video signal PS in one horizontal period is smaller than that of the pixels arranged in a horizontal direction in liquid crystal panel 80. In FIG. 7, a sampling clock signal SC is shown in a manner similar to that of FIG. 6. FIG. 7 also shows, as a typical example, an example in which liquid crystal panel 80 has 640 pixels in a horizontal direction.

Referring to FIG. 7, in this case, if pixel synchronization is carried out, the number of pulses of sampling clock signal SC which can be pixel-synchronized in one horizontal period is smaller than that of horizontally arranged pixels (640 pixels) of liquid crystal panel 80. In such a case, liquid crystal panel 80 has a white portion with no picture displayed at an end of a screen thereof. Accordingly, a picture cannot be displayed in an optimal condition.

As described above, in the conventional liquid crystal display apparatus, a picture cannot be displayed in an optimal condition if the number of dot data of a video signal PS in one horizontal period is smaller than that of horizontally arranged pixels of liquid crystal panel 80.

On the other hand, in order to display an optimal picture according to various computers which output video signals having characteristics different from each other in the conventional liquid crystal display apparatus having such an arrangement as described above, pixel synchronization must be carried out, and line data of a video signal and vertically arranged pixels of liquid crystal panel 80 must be made to correspond to each other on one-to-one basis.

FIG. 8 is a timing chart of signals at each portion of the liquid crystal display apparatus shown in FIG. 5, in which it is assumed that the number of line data and a video signal has in one vertical period is equal to or larger than that of vertically arranged pixels of the liquid crystal panel.

In FIG. 8, a video signal PS, a horizontal synchronizing signal HSS, a comparison signal PCS in PLL circuit 20, and a reset pulse signal RP are shown. The following is description of an example in which liquid crystal panel 80 has pixels of 640 (the number of horizontally arranged pixels) ×480 (the number of vertically arranged pixels).

Referring to FIG. 8, a video signal PS has at least 480 line data A1, A2, A3, . . . in one vertical period. One vertical period in this case corresponds to one period of a reset pulse signal RP.

If the number of line data of the video signal PS is equal to or larger than that of vertically arranged pixels (480 pixels) of liquid crystal panel 80, display in liquid crystal panel 80 is carried out as shown in FIG. 9.

FIG. 9 is a schematic diagram showing a condition of display in the liquid crystal panel based on a video signal. In FIG. 9, A1, A2, . . . , A480 respectively indicate lines corresponding to line data of the video signal PS of FIG. 8.

As shown in FIG. 9, the number of line data of the video signal PS is larger than that of vertically arranged pixels of liquid crystal panel 80, a normal picture is displayed at all the 480 vertical lines on liquid crystal panel 80.

However, the number of line data a video signal has in one vertical period might be smaller than that of vertically arranged pixels of liquid crystal panel 80, depending on a type of a computer. In such a case, the following problems will occur. Those problems will now be described specifically.

FIG. 10 is a timing chart showing signals at each portion of the liquid crystal display apparatus of FIG. 5, in which it is assumed that the number of line data a video signal PS has in one vertical period is smaller than that of vertically arranged pixels of liquid crystal panel 80. FIG. 10 also shows an example in which liquid crystal panel 80 has 480 pixels in a vertical direction. In FIG. 10 as well, signals of the same types as those in FIG. 8 are shown.

Referring to FIG. 10, the video signal PS has less than 480 line data A1, A2, . . . in one vertical period. A horizontal synchronizing signal HSS has 400 pulses in one vertical period in this case. In the figure, numerals shown above the horizontal synchronizing signal HSS respectively indicate the numbers of those pulses.

If the number of line data of the video signal PS is less than that of vertically arranged pixels (480 pixels) of liquid crystal panel 80, display in liquid crystal panel 80 is carried out as shown in FIG. 11.

FIG. 11 is a schematic diagram showing a condition of display in liquid crystal panel 80 based on the video signal PS of FIG. 10. In FIG. 11 as well, A1, A2, . . . , A480 respectively indicate lines corresponding to line data of the video signal PS in FIG. 10.

As shown in FIG. 11, if the video signal PS has line data less than the number of vertically arranged pixels of liquid crystal panel 80 in one vertical period, all the line data A1 to A400 are respectively displayed at a 1st line to a 400th line on the screen of liquid crystal panel 80.

Furthermore, the same line data A1, A2, . . . as those displayed at a 1st line to a 80th line are displayed at remaining 80 lines, respectively. In other words, there is an overlap in the picture displayed on the screen of liquid crystal panel 80.

Such an overlap in the picture as described above results from the fact that a reset pulse RP is input while all the lines of liquid crystal panel 80 are being scanned since the number of line data of the video signal PS is less than 480.

As described above, in the conventional liquid crystal display apparatus, if the number of line data the video signal has in one vertical period is smaller than that of vertically arranged pixels of the liquid crystal display apparatus, an overlap is produced in the picture displayed on the liquid crystal panel.

SUMMARY OF THE INVENTION

It is one object of the present invention to provide a liquid crystal display apparatus capable of displaying an optimal picture even if the number of dot data in one horizontal period of an input video signal is smaller than that of horizontally arranged pixels of a liquid crystal panel.

It is another object of the present invention to provide a liquid crystal display apparatus capable of displaying an optimal picture without producing an overlap in the picture even if the number of line data in one vertical period in an input video signal is smaller than that of vertically arranged pixels of a liquid crystal panel.

According to one aspect of the present invention, a liquid crystal display apparatus for displaying a picture on a liquid crystal panel in response to a video signal having a prescribed number of data in one period of a periodic signal includes a storage circuit and a read signal generating circuit. Data of the video signal is written to the storage circuit. The read signal generating circuit supplies to the storage circuit, a read clock signal for reading data from the storage circuit for one period, and a control signal for reading prescribed information from the storage circuit as dummy data from the time when the number of data read from the storage circuit in one period exceeds the number of data of the video signal in one period until that one period is completed.

According to another aspect of the present invention, a liquid crystal display apparatus for displaying a picture on a liquid crystal panel in response to a video signal having a prescribed number of dot data in one horizontal period includes a storage circuit and a read signal generating circuit. Dot data of the video signal is written to the storage circuit. The read signal generating circuit supplies to the storage circuit, a read clock signal for reading data from the storage circuit for one horizontal period, and a control signal for reading prescribed information from the storage circuit as dummy data from the time when the number of clock of the read clock signal in one horizontal period exceeds the number of dot data of the video signal in one horizontal period until that one period is completed.

According to a further aspect of the present invention, a liquid crystal display apparatus for displaying a picture on a liquid crystal panel in response to a video signal having a prescribed number of line data in one vertical period includes a storage circuit and a read signal generating circuit. Line data of the video signal is written to the storage circuit. The read signal generating circuit supplies to the storage circuit, a read clock signal for reading data required for display on the liquid crystal panel for one horizontal period, and a control signal for reading prescribed information from the storage circuit as dummy data from the time when the number of line data read from the storage circuit in one vertical period exceeds the number of line data of the video signal in one horizontal period until that one vertical period is completed.

Therefore, according to the present invention, dot data of the video signal is written. Dot data written to the storage circuit is read in response to the read clock signal supplied from the read signal generating circuit. Furthermore, prescribed information is read from the storage circuit as dummy data in response to a control signal supplied from the read signal generating circuit, from the time when the number of clocks of a read clock signal in one horizontal period exceeds the number of dot data of a video signal until that one horizontal period is completed.

Accordingly, if the number of dot data of a video signal in one horizontal period is smaller than the number required for display on the liquid crystal panel, a video signal used for display on the liquid crystal panel is a signal in which dummy data is added to dot data.

As a result, even if the number of dot data of a video signal in one horizontal period is smaller than the number required for display on the liquid crystal panel, a video signal having the number of data required for display on the liquid crystal panel can be obtained, allowing display of an optimal picture.

On the other hand, according to the present invention, line data of a video signal is written to the storage circuit. Line data written to the storage circuit is read in response to a read clock signal supplied from the read signal generating circuit.

Furthermore, prescribed information is output from the storage circuit as dummy data in response to a control signal supplied from the read signal generating circuit, from the time when the number of line data read from the storage circuit in one vertical period exceeds the number of line data of a video signal in one horizontal period until that vertical period is completed.

Accordingly, if the number of line data of a video signal is smaller than the number required for display on the liquid crystal panel, a video signal used for display on the liquid crystal panel is a signal in which dummy data is added to line data.

As a result, even if the number of line data of a video signal in one vertical period is smaller than the number required for display on the liquid crystal panel, a video signal having the number of line data required for display on the liquid crystal panel can be obtained, allowing display of an optimal picture.

Although the present invention has been described and illustrated in detail, it is clearly understood that the same is by way of illustration and example only and is not to be taken by way of limitation, the spirit and scope of the present invention being limited only by the terms of the appended claims.

DESCRIPTION OF THE PREFERRED EMBODIMENTS

Embodiments of the present invention will now be described in conjunction with the accompanying drawings.

[Embodiment 1]

Figure 1:
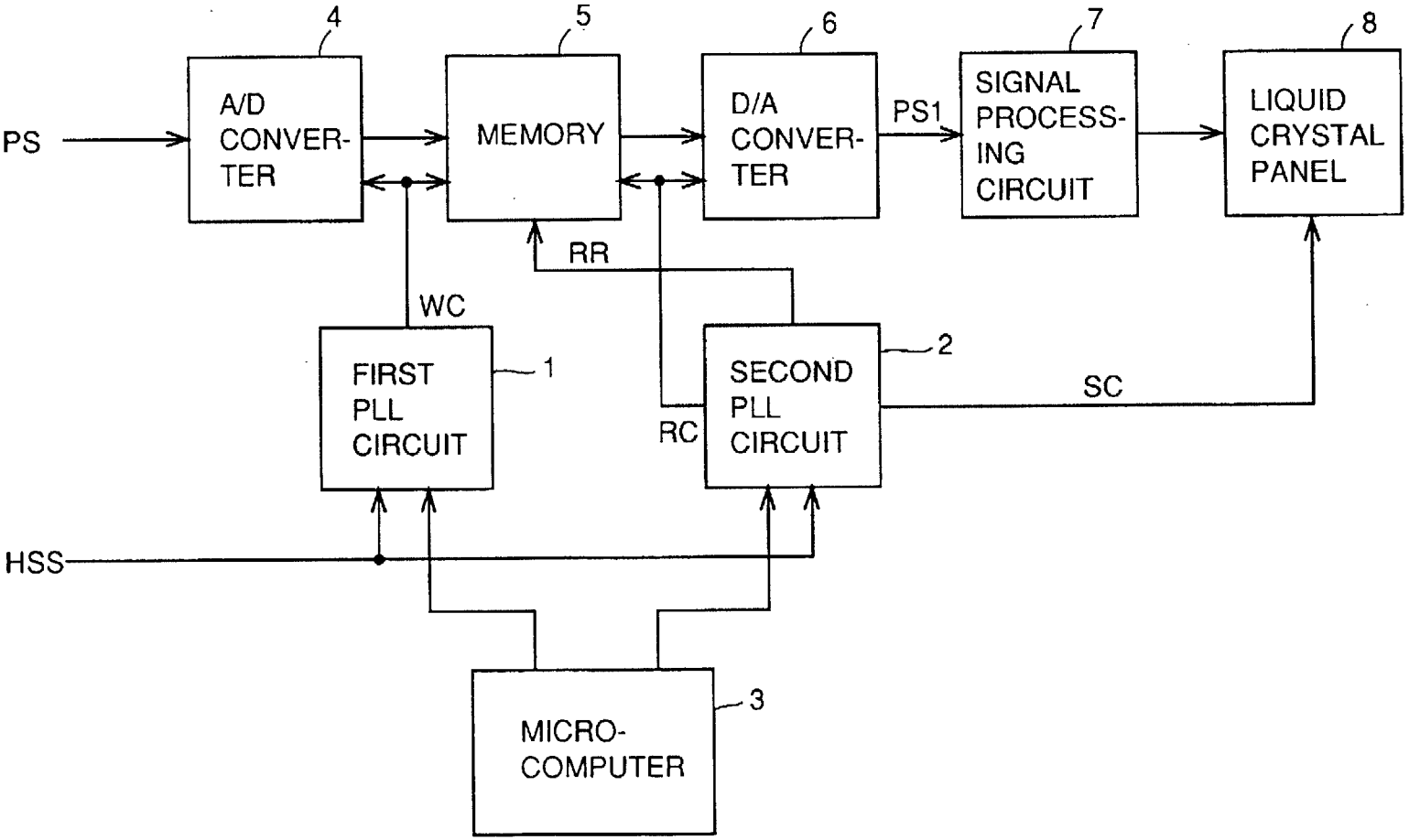
FIG. 1 is a block diagram showing an arrangement of a main portion of a liquid crystal display apparatus in accordance with a first embodiment of the present invention.

FIG. 1 is a block diagram showing an arrangement of a main portion of a liquid crystal display apparatus in accordance with a first embodiment of the present invention.

Referring to FIG. 1, this liquid crystal display apparatus includes a first PLL circuit 1, a second PLL circuit 2, a microcomputer 3, an A/D converter 4, a memory 5, a D/A converter 6, a signal processing circuit 7, and a liquid crystal panel 8. The following is description of an example in which this liquid crystal display apparatus is connected to a computer, and receives signals such as a video signal PS and a horizontal synchronizing signal HSS from that computer.

First PLL circuit 1 includes a frequency divider in a phase locked loop, and is constituted so that a period of an oscillating write clock signal WC can be varied by changing frequency division ratio of the frequency divider. First PLL circuit 1 receives a horizontal synchronizing signal HSS as a reference signal for phase synchronization, and also receives data of frequency division ratio from microcomputer 3. The frequency division ratio of the frequency divider in first PLL circuit 1 is set according to the data of frequency division ratio.

The data of frequency division ratio supplied from microcomputer 3 to first PLL circuit 1 is set to such a value that a write clock signal WC and dot data of a video signal PS are pixel-synchronized with each other. Accordingly, this data of frequency division ratio is different depending on a computer to which the liquid crystal display apparatus is connected. Therefore, such data of frequency division ratio is pre-stored in microcomputer 3, according to a typical computer which can be connected to the liquid crystal display apparatus.

First PLL circuit 1 supplies, to A/D converter 4 and memory 5, a write clock signal WC which is pixel synchronized with a video signal PS using a horizontal synchronizing signal HSS as a reference signal.

A/D converter 4 further receives a video signal PS, converts that video signal PS from analog into digital based on a write clock signal WC, and supplies the converted signal to memory 5. Dot data of a video signal PS is written into memory 5 based on a write clock signal WC supplied to each of A/D converter 4 and memory 5.

Second PLL circuit 2 includes a frequency divider (not shown) in a phase locked loop, and is constituted so that a period of each of oscillating read clock signal RC and sampling clock signal SC can be varied by changing frequency division ratio of the frequency divider.

Furthermore, second PLL circuit 2 generates a read reset signal RR (or a read enable signal) for reading dummy data from memory 5. This read reset signal RR also serves as a signal for resetting read operation in memory 5.

Second PLL circuit 2 receives a horizontal synchronizing signal HSS as a reference signal for phase synchronization, and also receives from microcomputer 3 data of frequency division ratio according to a computer connected, and reset data for generating a read reset signal RR (or a read enable signal). The frequency division ratio of the frequency divider in second PLL circuit 2 is set according to the data of frequency division ratio.

The reset data is data for defining an output timing and an output period of a read reset signal RR. In other words, the reset data is data for defining a timing at which and a period during which dummy data is output from memory 5.

A frequency of a read clock signal RC output from second PLL circuit 2 is set to a value higher than that of a frequency of a write clock signal WC. More specifically, a read period during which data is read in response to a read clock signal RC is shorter than a write period during which data is written in response to a write clock signal WC. Consequently, an amount of data read from memory 5 in one horizontal period is larger than that written into memory 5 in one horizontal period.

A read clock signal RC is supplied to memory 5 and D/A converter 6. A read reset signal RR is supplied to memory 5. A sampling clock signal SC is supplied to liquid crystal panel 8. Data is read from memory 5 in response to the read clock signal RC.

Furthermore, dummy data is read from memory 5 in response to the read reset signal RR. The dummy data is read for a period during which there is no dot data of a video signal PS in one horizontal period. D/A converter 6 converts data read from memory 5 from digital into analog, and supplies the converted video signal PS1 to signal processing circuit 7.

Signal processing circuit 7 includes processing circuits (not shown) such as a polarity inversion circuit, a blanking processing circuit and the like. Signal processing circuit 7 carries out polarity inversion processing and blanking processing for the video signal PS1. The video signal PS1 processed as described above is supplied from signal processing circuit 7 to liquid crystal panel 8.

Signal processing circuit 7 carries out blanking processing for a dummy data portion of the video signal PS1 in one horizontal period. Thus, the dummy data portion forms a blanking period.

In liquid crystal panel 8, a plurality of liquid crystal cells (not shown) each of which constitutes a pixel are arranged in a matrix form. This liquid crystal panel 8 includes a driver circuit for driving the liquid crystal cells. In this liquid crystal panel 8, a video signal applied is sampled based on a sampling clock signal SC, and a picture is displayed based on the sampled video signal.

A characteristic operation of the liquid crystal display apparatus shown in FIG. 1 will now be described in conjunction with a timing chart of each signal.

Figure 2:
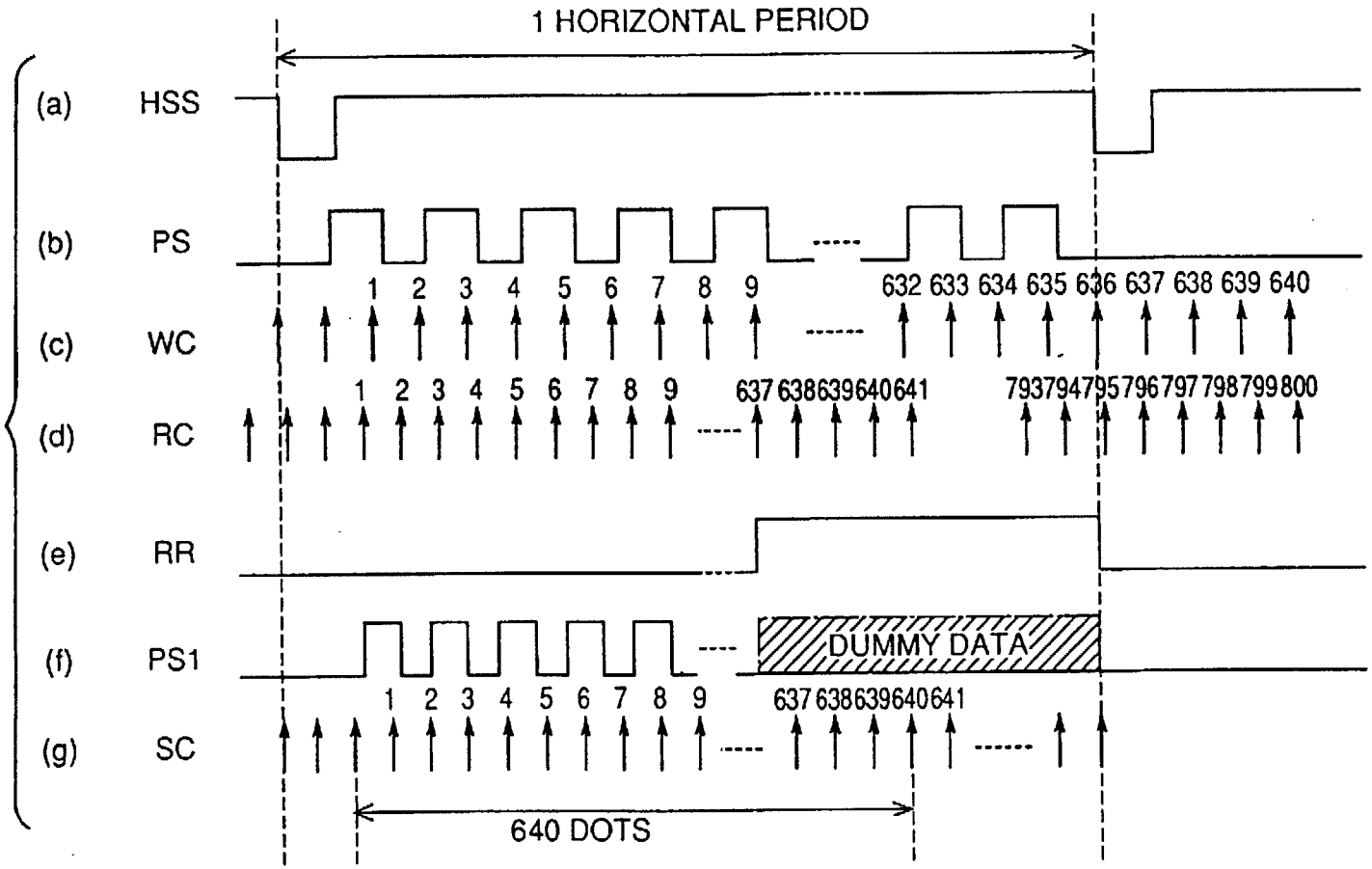
FIG. 2 is a timing chart showing an operation of the liquid crystal display apparatus shown in FIG. 1.

FIG. 2 is a timing chart showing an operation of the liquid crystal display apparatus of FIG. 1. In FIG. 2, a horizontal synchronizing signal HSS, a video signal PS, a write clock signal WC, a read clock signal RC, a read reset signal RR, a video signal PS1, and a sampling clock signal SC are shown.

In FIG. 2, each pulse is shown by an upward arrow for each of the write clock signal WC, the read clock signal RC and the sampling clock signal SC, and the number of each pulse is shown above the arrow. FIG. 2 shows an example in which liquid crystal panel 8 has pixels of 640 dots in a horizontal direction and the video signal PS has dot data less than 640 dots in one horizontal period.

Referring to FIG. 2, dot data of video signal PS is written into memory 5 in synchronization with pixel synchronized write clock signal WC. Then, dot data written into memory 5 is read at a high speed in synchronization with a read clock signal RC having a period shorter than that of the write clock signal WC.

As data continues to be read from memory 5, dot data to be read in one horizontal period runs short. This is because the number of dot data of the video signal PS in one horizontal period is less than 640 dots.

The read reset signal RR rises to an H level at the time when dot data to be read is finished. The read reset signal RR is held at an H level until one horizontal period is completed.

When the read reset signal RR rises to an H level, read operation from memory 5 is reset, and dummy data is read from memory 5. The dummy data continues to be read until one horizontal period is completed.

For example, dummy data in this case is data which is read again sequentially from the first address of dot data stored in memory 5. It is noted that the dummy data can be any data which corresponds to dummy dot data.

Since dummy data is read in such a manner as described above, a video signal PS1 of one horizontal period is data in which dummy data is added to regular dot data based on a video signal PS.

In order to display an optimal picture on liquid crystal panel 8, a video signal PS1 having, in one horizontal period, dot data corresponding to each of 640 dots of a sampling clock signal, which correspond to the number of horizontal pixels is required.

In the video signal PS1, dummy dot data (dummy data) used for a period during which there is no regular dot data in one horizontal period is added to regular dot data an input video signal PS has in one horizontal period. Thus, in liquid crystal panel 8, a video signal PS1 having, in one horizontal period, dot data corresponding to all the 640 dots of a sampling clock signal SC which are required for one horizontal period is supplied.

As a result, a picture can be displayed in an optimal condition in liquid crystal panel 8. Since the dummy data portion of the video signal PS1 in this case has been subjected to blanking processing in signal processing circuit 7, a black picture, for example, is displayed on the screen of liquid crystal panel 8 for that dummy data portion.

As described above, in this liquid crystal display apparatus, if the number of dot data an input video signal PS has in one horizontal period is smaller than the number of horizontal pixels of liquid crystal panel 8, dummy data is added to the dot data of the video signal PS. Accordingly, the number of dot data required for displaying an optimal picture can be ensured.

As a result, a picture can be displayed in an optimal condition regardless of a type of a computer to which the liquid crystal display apparatus is connected.

[Embodiment 2]

Figure 3:
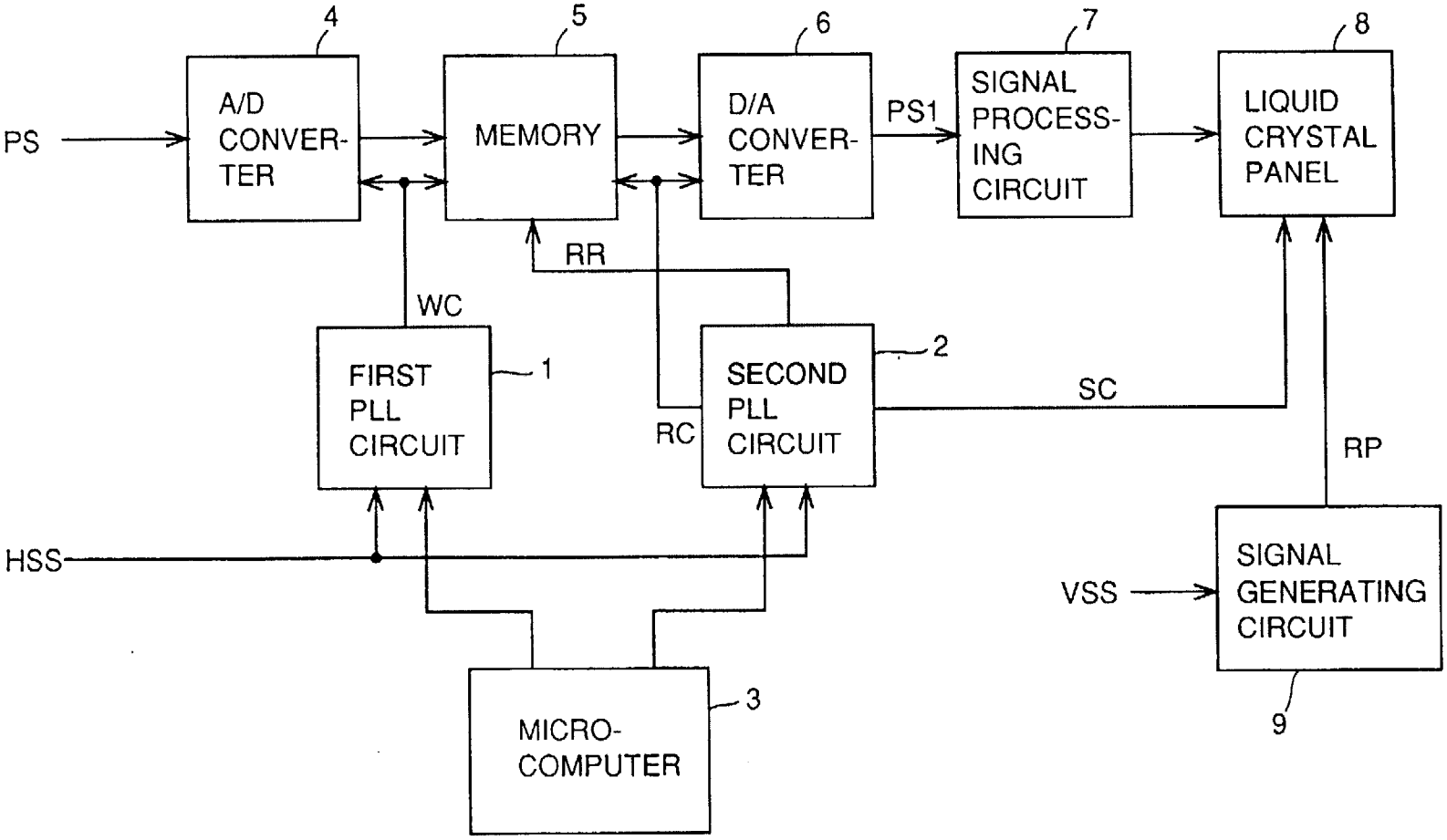
FIG. 3 is a block diagram showing an arrangement of a main portion of a liquid crystal display apparatus in accordance with a second embodiment of the present invention.

FIG. 3 is a block diagram showing an arrangement of a main part of a liquid crystal display apparatus in accordance with a second embodiment of the present invention.

The liquid crystal display apparatus includes a first PLL circuit 1, a second PLL circuit 2, a microcomputer 3, an A/D converter 4, a memory 5, a D/A converter 6, a signal processing circuit 7, a liquid crystal panel 8, and a signal generating circuit 9.

The following is description of an example in which the liquid crystal display apparatus is connected to a computer and receives signals such as a video signal, a horizontal synchronizing signal and the like from that computer.

Referring to FIG. 3, first PLL circuit 1 includes a frequency divider (not shown) in a phase locked loop, and is constituted so that a frequency of an oscillating write clock signal WC can be varied by changing frequency division ratio of the frequency divider.

First PLL circuit 1 receives a horizontal synchronizing signal HSS as a reference signal for phase synchronization, and also receives data of frequency division ratio from microcomputer 3. The data of frequency division ratio supplied from microcomputer 3 is set to such a value that a write clock signal WC output from first PLL circuit 1 and dot data of a video signal PS are pixel-synchronized with each other. The frequency division ratio of the frequency divider is set based on the data of frequency division ratio.

First PLL circuit 1 supplies to A/D converter 4 and memory 5, a write clock signal WC which are pixel-synchronized with the video signal PS using the horizontal synchronizing signal HSS as a reference signal. In this PLL circuit 1, an output signal of the frequency divider is a signal compared to a reference signal (this compared signal is hereinafter referred to as a comparison signal). Therefore, that comparison signal is compared to and phase-synchronized with the horizontal synchronizing signal HSS.

A/D converter 4 further receives a video signal PS, converts that video signal PS from analog to digital, and applies the converted signal to memory 5. Dot data of the video signal PS is written into memory 5 in synchronization with the write clock signal WC which is supplied from first PLL circuit 1 to each of A/D converter 4 and memory 5. Thus, prescribed number of line data are written in one vertical period. More specifically, line data is a collection of dot data.

Second PLL circuit 2 includes a frequency divider (not shown), and is constituted so that frequencies of oscillating read clock signal RC and sampling clock signal SC can be varied by changing frequency division ratio of the frequency divider. Furthermore, second PLL circuit 2 generates a read reset signal (or a read enable signal) for resetting read operation from memory 5.

Second PLL circuit 2 receives a horizontal synchronizing signal HSS as a reference signal for phase synchronization, and also receives from microcomputer 3 data of frequency division ratio according to a computer connected and reset data for generating a read reset signal RR.

The reset data is data for defining output timing and an output period of the read reset signal RR, and is different depending on a computer connected.

More specifically, the reset data defines an output timing and an output period of the read reset signal RR so that the read reset signal RR continues to be output from the time when all the line data the video signal PS has in one vertical period have been read until that one vertical period is completed. Such reset data is predetermined for each of computers which can be connected to the liquid crystal display apparatus, and has been stored in microcomputer 3.

In PLL circuit 2, an output signal of the frequency divider is a signal compared to a reference signal (This compared signal is hereinafter referred to as a comparison signal.) Therefore, the comparison signal is compared to and phase-synchronized with the horizontal synchronizing signal HSS.

Frequencies of a sampling clock signal SC and a read clock signal WC which are output from second PLL circuit 2 are respectively set to values higher than that of a frequency of a write clock signal WC.

The read clock signal RC is supplied to memory 5 and D/A converter 6. The read reset signal RR is supplied to memory 5. The sampling clock signal SC is supplied to liquid crystal panel 8.

Data is read from memory 5 in response to the read clock signal RC. Then, dummy data is read from memory 5 in response to the read reset signal RR. The dummy data is read for a period during which there is no line data to be read in one vertical period. D/A converter 6 converts data read from memory 5 from digital to analog, and supplies the converted video signal PS1 to signal processing circuit 7.

Signal processing circuit 7 includes processing circuits such as a polarity inversion circuit and a blanking processing circuit (both of which are not shown). Signal processing circuit 7 carries out polarity inversion and blanking processing for the video signal PS1, and supplies the processed video signal to liquid crystal panel 8.

Blanking processing in signal processing circuit 7 is carried out for a dummy data portion of the video signal PS1 in one vertical period. Thus, that dummy data portion forms a blanking period.

In liquid crystal panel 8, liquid crystal cells (not shown) constituting pixels are arranged in a matrix form. This liquid crystal panel 8 further includes driver circuits (not shown) consisting of shifting circuits for driving the liquid crystal cells.

Liquid crystal panel 8 receives a reset pulse signal RP generated from a prescribed signal generating circuit 9. This reset pulse signal RP is generated based on a vertical synchronizing signal VSS, and may have the same period as that of the vertical synchronizing signal and phase different from that of the vertical synchronizing signal.

Upon display, liquid crystal panel 8 determines data of video signal (line data) with which display in a vertical direction of the screen is initiated, based on the reset pulse signal RP. In other words, in response to generation of one pulse of the reset pulse signal RP, line data with which display is initiated is determined out of line data contained in one vertical period.

Then, in liquid crystal panel 8, a video signal is sampled based on a sampling clock signal SC, and a picture is displayed based on data of the sampled video signal.

Operation of the liquid crystal display apparatus of FIG. 3 will now be described.

Figure 4:
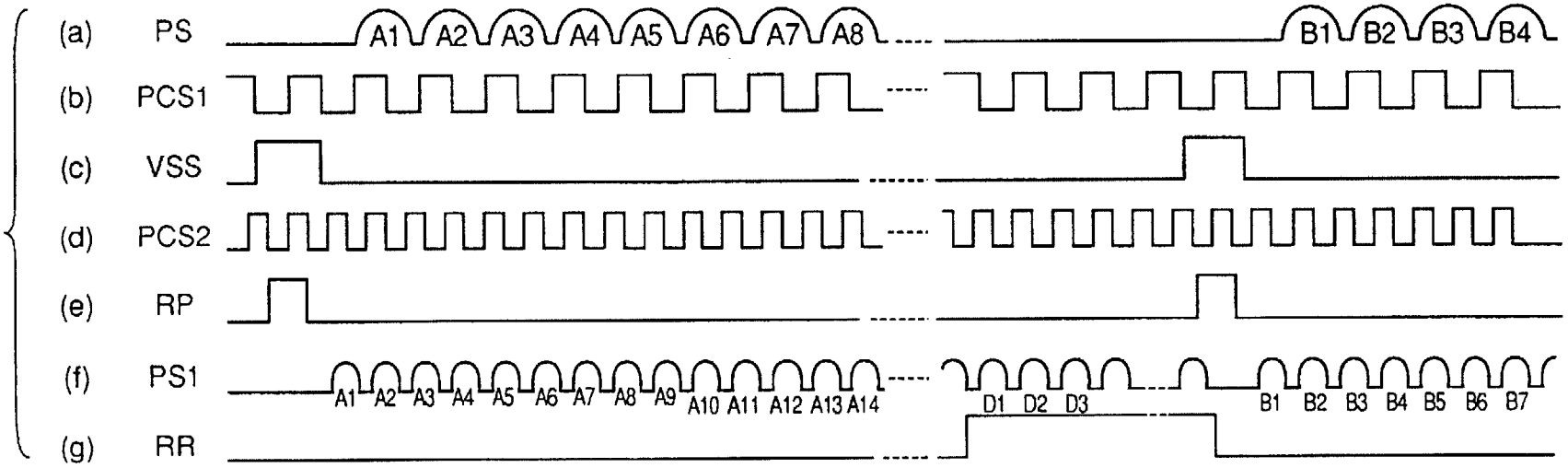
FIG. 4 is a timing chart showing an operation of the liquid crystal display apparatus shown in FIG. 1.
Figure 5:
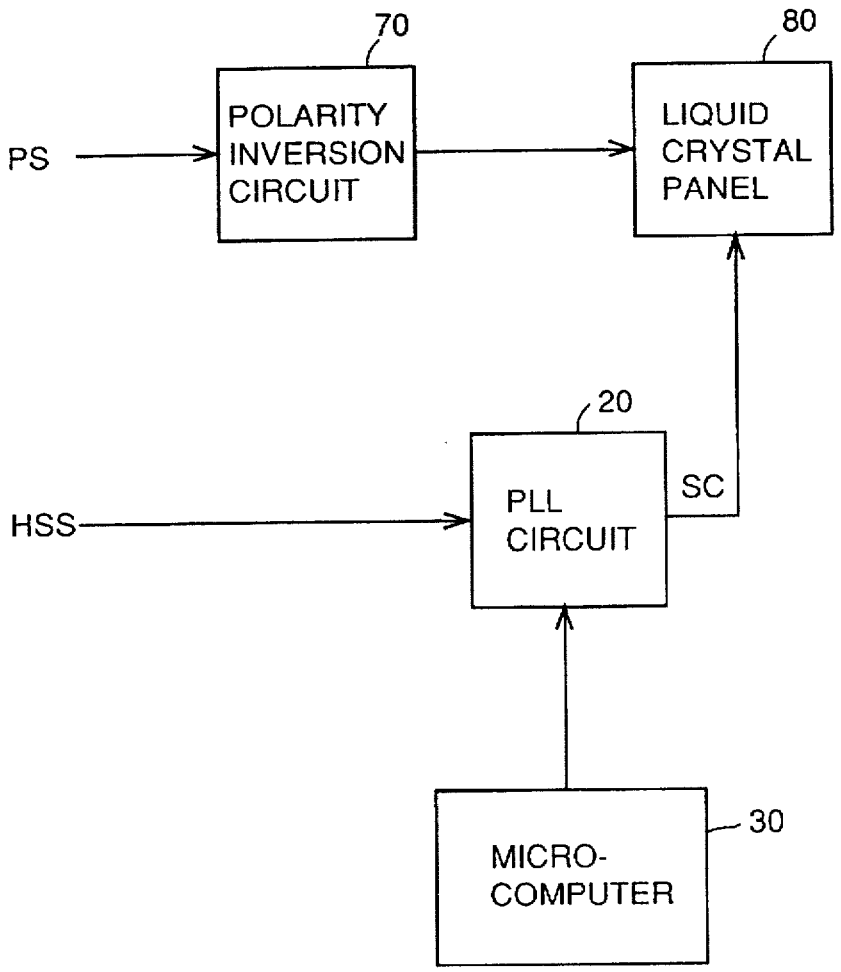
FIG. 5 PRIOR ART
FIG. 5 is a block diagram showing an arrangement of a main portion of a conventional liquid crystal display apparatus.
Figure 6:
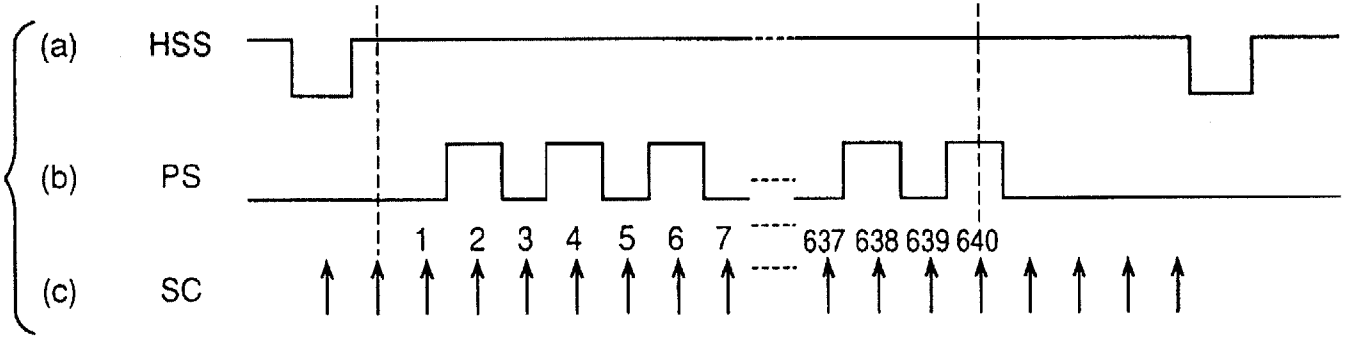
FIG. 6 PRIOR ART
FIG. 6 is a timing chart showing a condition of signals when pixel synchronization is carried out in the liquid crystal display apparatus shown in FIG. 5.
Figure 7:
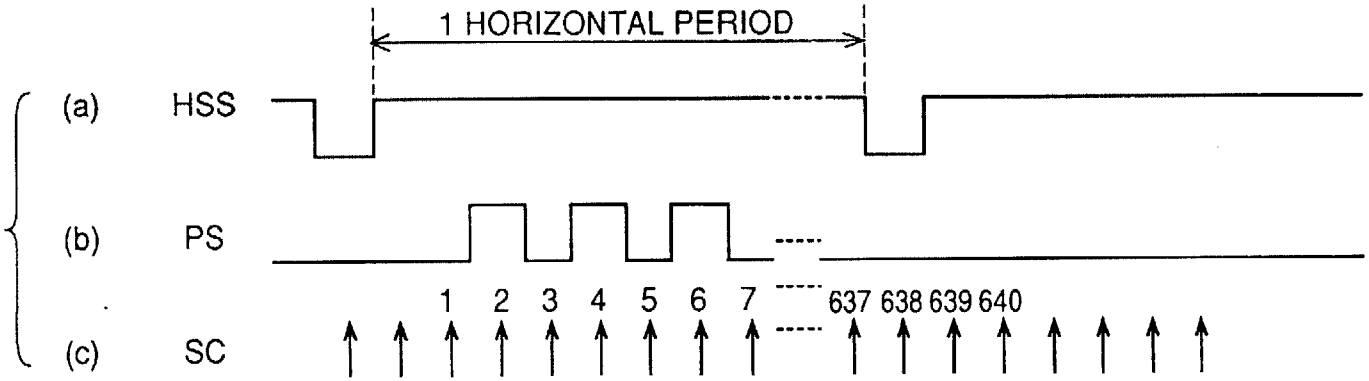
FIG. 7 PRIOR ART
FIG. 7 is a timing chart showing a condition of signals when the number of dot data of a video signal in one horizontal period is smaller than the number of horizontally arranged pixels of a liquid crystal panel in the liquid crystal display apparatus shown in FIG. 5.
Figure 8:
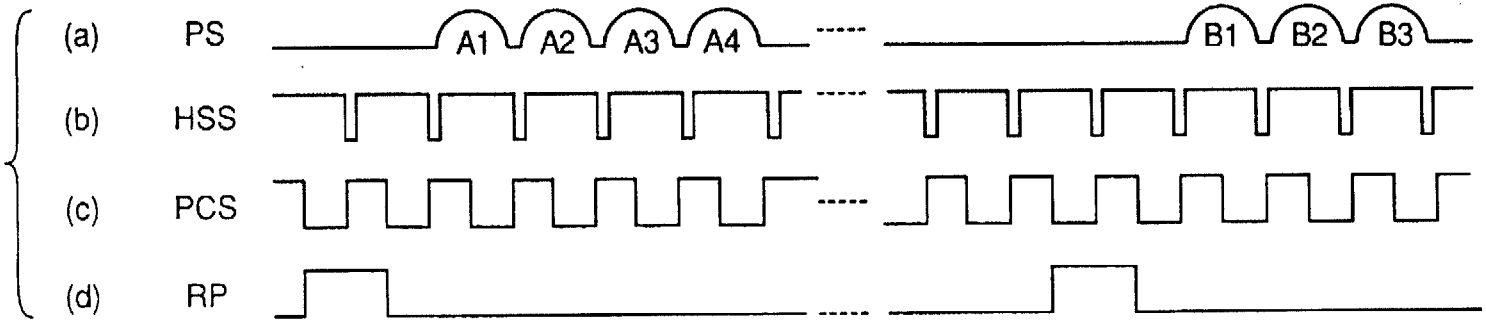
FIG. 8 PRIOR ART
FIG. 8 is a timing chart showing a condition of signals at each portion of the liquid crystal display apparatus shown in FIG. 5 when the number of line data of a video signal is equal to or larger than the number of vertically arranged pixels of the liquid crystal panel.
Figure 9:
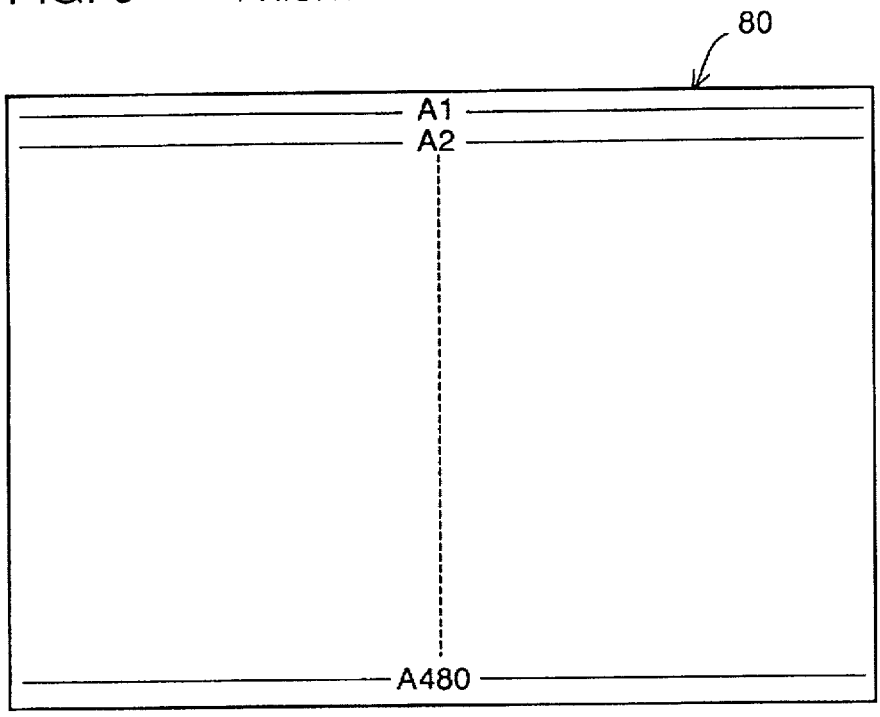
FIG. 9 PRIOR ART
FIG. 9 is a schematic diagram showing a condition of display on the liquid crystal panel based on the video signal of FIG. 8.
Figure 11:
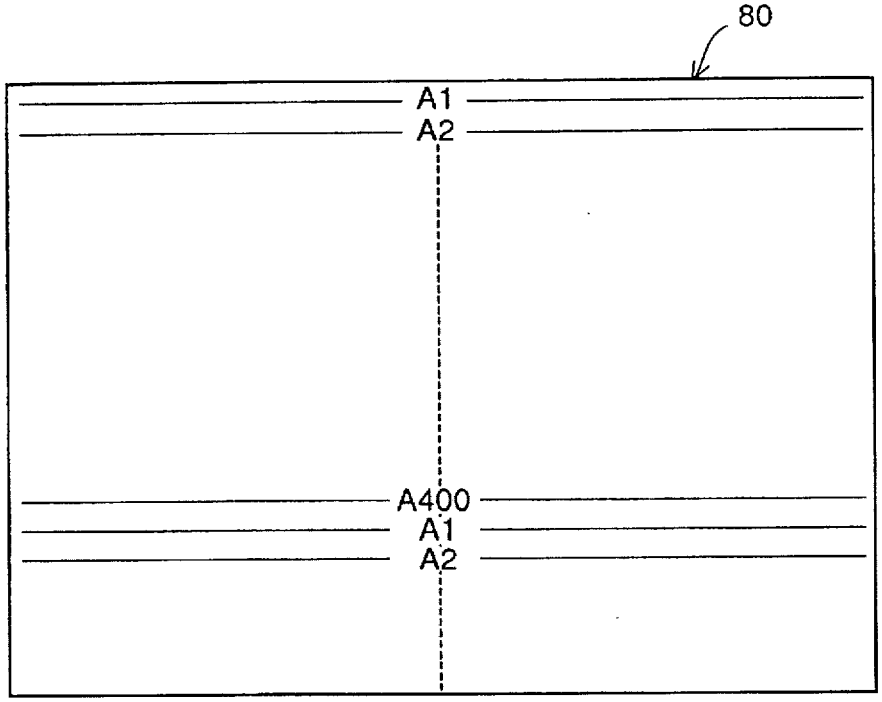
FIG. 11 PRIOR ART
FIG. 11 is a schematic diagram showing a condition of display on the liquid crystal panel based on the video signal of FIG. 10.
Figure 10:
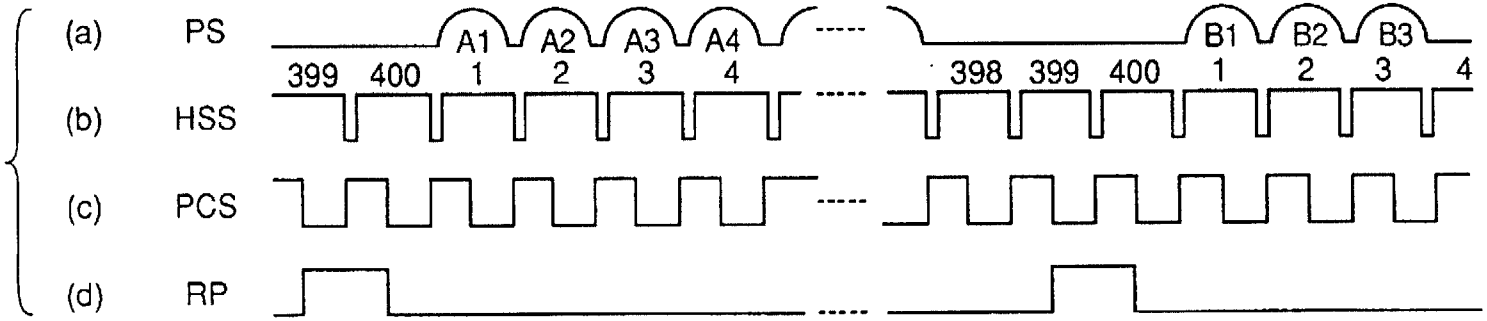
FIG. 10 PRIOR ART
FIG. 10 is a timing chart of signals at each portion of the liquid crystal display apparatus of FIG. 5 when the number of line data of a video signal is smaller than the number of vertically arranged pixels of the liquid crystal panel.

FIG. 4 is a timing chart showing the operation of the liquid crystal display apparatus of FIG. 3. In FIG. 4, a video signal PS, a comparison signal PCS1 of first PLL circuit 1, a vertical synchronizing signal VSS, a comparison signal PCS2 of second PLL circuit 2, a reset pulse signal RP, a video signal PS1, and a read reset signal RR are shown.

FIG. 4 shows an example in which liquid crystal panel 8 has pixels of 480 dots in a vertical direction, and the video signal PS has line data less than 480 dots in one vertical period.

Referring to FIG. 4, the video signal PS has less than 480 line data A1, A2, . . . in one vertical period. Dot data of the video signal PS is written into memory 5 in synchronization with a pixel-synchronized write clock signal WC.

As this dot data continues to be written, one line data is written in one horizontal period, and less than 480 line data are written in one vertical period.

Dot data written into memory 5 is read at a high speed in synchronization with a read clock signal RC having a period shorter than that of a write clock signal WC. As the dot data continues to be read, one line data is read in one horizontal period. Then, all the line data of less than 480 which have been written corresponding to one vertical period are read in one vertical period.

As the line data continues to be read, line data (dot data) to be read in one vertical period runs short. This is because the number of line data of the video signal PS is less than 480, that is, less than the number of horizontal pixels of liquid crystal panel 8.

The read reset signal RR rises to an H level at the time when line data to be read is finished. The read reset signal is held at an H level until one vertical period is completed. When the read reset signal RR attains an H level, read operation from memory 5 is reset, and dummy data is read from memory 5. The dummy data continues to be read until the vertical period is completed.

For example, dummy data in this case is data which is read again sequentially from the first address of line data stored in memory 5. It is noted that the dummy data can be any data which corresponds to dummy line data.

Accordingly, the video signal PS1 in one horizontal period forms data in which dummy data D1, D2, . . . are added to regular line data A1, A2, . . . based on the video signal PS.

In order to display an optimal picture having no overlapping portion in liquid crystal panel 8, the video signal PS1 must have, in one vertical period, 480 line data which correspond to the number of vertical pixels of liquid crystal panel 8.

In the video signal PS1, dummy data is added for a period during which there is no regular line data in one vertical period. Accordingly, in liquid crystal panel 8, the video signal PS1 having the number of line data required for one vertical period is supplied.

As a result, a picture can be displayed in an optimal condition in liquid crystal panel 8. In this case, since the dummy data portion of the video signal PS1 is subjected to blanking processing in signal processing circuit 7, it is displayed, for example, in black on the screen of liquid crystal panel 8.

As described above, in the liquid crystal panel apparatus, dummy data is added to line data of a video signal PS even when the number of line data an input video signal PS has in one vertical period is less than the number of vertical pixels of liquid crystal panel 8. Accordingly, data relating to a picture which is required for optimal liquid crystal display in a vertical direction can be ensured.

As a result, a picture can be displayed in an optimal condition regardless of a type of a computer to which the liquid crystal display apparatus is connected.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A liquid crystal display apparatus for displaying a picture on a liquid crystal panel in response to a video signal having a prescribed number of data in one period of a synchronizing signal, comprising:

storage means for storing data of said video signal therein; and read signal generating means for supplying, to said storage means, a read clock signal for reading data from said storage means for said one period, and a control signal for reading dummy data from said storage means from a time when the number of data read from said storage means for said one period exceeds the number of data of said video signal in said one period until said one period is completed.

2. A liquid crystal display apparatus for displaying a picture on a liquid crystal panel in response to a video sinal having a prescribed number of dot data in one horizontal period, comprising:

storage means for storing dot data of said video signal therein; and read signal generating means for supplying, to said storage means, a read clock signal for reading data from said storage means for one horizontal period, and a control signal for reading dummy data from said storage means from a time when the number of clocks of said read clock signal in said one horizontal period exceeds the number of dot data of said video signal in said one horizontal period until said one horizontal period is completed.

3. The liquid crystal display apparatus according to claim 2, further comprising:

write signal generating means for supplying to said storage means a write clock signal for writing said dot data into said storage means, wherein a read period of said read clock signal is shorter than a write period of said write clock signal.

4. A liquid crystal display apparatus for displaying a picture on a liquid crystal panel in response to a video signal having a prescribed number of line data in one vertical period, comprising:

storage means for storing line data of said video signal therein; and read signal generating means for supplying, to said storage means, a read clock signal for reading data required for display on said liquid crystal panel for said one vertical period, and a control signal for reading dummy data from said storage means from a time when the number of line data read from said storage means in said one vertical period exceeds the number of line data of said video signal in said one vertical period until said one vertical period is completed.

5. The liquid crystal display apparatus according to claim 4, further comprising:

write signal generating means for supplying to said storage means a write clock signal for writing said line data into said storage means, wherein a read period of said read clock signal is shorter than a write period of said write clock signal.

* * * * *